US007922412B2

(12) United States Patent
Miyamoto et al.

(10) Patent No.: US 7,922,412 B2
(45) Date of Patent: Apr. 12, 2011

(54) FLUID FEEDER OF APPLICATOR

(75) Inventors: Kouhei Miyamoto, Fujioka (JP); Tadashi Kouriki, Fujioka (JP)

(73) Assignee: Mitsubishi Pencil Company, Limited, Shinagawa-Ku, Tokyo (JP)

( * ) Notice: Subject to any disclaimer, the term of this patent is extended or adjusted under 35 U.S.C. 154(b) by 0 days.

(21) Appl. No.: 12/742,597

(22) PCT Filed: Nov. 4, 2008

(86) PCT No.: PCT/JP2008/070049
§ 371 (c)(1),
(2), (4) Date: May 12, 2010

(87) PCT Pub. No.: WO2009/063775
PCT Pub. Date: May 22, 2009

(65) Prior Publication Data

US 2010/0272496 A1 Oct. 28, 2010

(30) Foreign Application Priority Data

Nov. 14, 2007 (JP) ..... 2007-295282

(51) Int. Cl.
*A47L 13/30* (2006.01)

(52) U.S. Cl. ..... 401/264; 401/206

(58) Field of Classification Search ..... 401/107, 401/108, 205, 206, 263, 264; 251/318, 320–323
See application file for complete search history.

(56) References Cited

U.S. PATENT DOCUMENTS 4,541,552 A 9/1985 Scheithauer
4,685,820 A * 8/1987 Kremer et al. ..... 401/260
4,976,564 A * 12/1990 Fukuoka et al. ..... 401/206
(Continued)

FOREIGN PATENT DOCUMENTS

JP 1-148776 U 10/1989
(Continued)

OTHER PUBLICATIONS

*International Search Report (PCT/ISA/210) dated Feb. 3, 2009.
(Continued)

*Primary Examiner* — David J Walczak
(74) *Attorney, Agent, or Firm* — Buchanan Ingersoll & Rooney PC

(57) ABSTRACT

To provide a fluid feeder of an applicator having a structure that allows a fluid to flow into a tubular member and be positively pressurized at the time of an ejecting operation, which can readily eject the fluid even if the fluid becomes unlikely to flow out and which allows the user to readily use over a long period of time even if a high-viscosity fluid is used. In the fluid feeder of an applicator, at the time of the closed state, the periphery of a base of a rod-like part comes into hermetic contact with the inner peripheral surface of a fore part of a tubular member. When the thrust against pressing end is weakened after an open state and then the fluid is pressurized before returning to the closed state, the plunger-like part is inserted into the cylinder surface so as to pressurize the fluid held in the space between the inner surface of tubular member and the outer surface on the front side of a step of a valve member, whereby the fluid is flowed out from an ejection opening that is in a state where the periphery of base of valve member is released from the inner peripheral surface of fore part of tubular member.

3 Claims, 8 Drawing Sheets

U.S. PATENT DOCUMENTS

| | | | | |
|---|---|---|---|---|
| 5,387,046 | A | 2/1995 | Danno | |
| 6,641,320 | B1 * | 11/2003 | Ballot et al. | 401/206 |
| 2010/0014906 | A1 | 1/2010 | Nakatani et al. | |

FOREIGN PATENT DOCUMENTS

| | | | |
|---|---|---|---|
| JP | 6-39167 | U | 5/1994 |
| JP | 7-24472 | U | 5/1995 |
| JP | 08-10395 | Y2 | 3/1996 |
| JP | 08-24885 | B2 | 3/1996 |
| JP | 11-300263 | A | 11/1999 |
| JP | 2006-346975 | A | 12/2006 |
| WO | WO 91/18750 | A1 | 12/1991 |

OTHER PUBLICATIONS

International Preliminary Report on Patentability and English translation mailed in corresponding International Patent Application No. PCT/JP2008/070049, May 18, 2010, The International Bureau of WIPO, Geneva, CH.

Supplemental European Search Report dated Feb. 1, 2011 issued in corresponding European Patent Application No. 08848882.0/2304/2221188.

* cited by examiner (a)

(b)

(c)

FLUID FEEDER OF APPLICATOR

TECHNICAL FIELD

The present invention relates to a fluid feeder of an applicator for applying a fluid (including application fluids such as correction fluids, liquids such as ink etc.) onto an applied object.

BACKGROUND ART

In the field of applicators that apply a fluid to an applied object, correction fluid applicators (correction pens) for applying a correction fluid to a paper surface have been widely used in order to correct errors in text and the like on the paper surface. The applicator of this kind includes a valve mechanism using a spring and opens and closes the valve mechanism to thereby open and close the ejection opening of the correction fluid.

Concerning the above applicators, the applicator described in Japanese Utility Model Application Laid-open HEI 07-24472 (patent document 1) is provided with a correction fluid feeder b at the front end of a container body a, as shown in FIG. 9. In this correction fluid feeder b, a front barrel f of a tubular member with a fluid ejection opening c at the tip is formed with an applying surface d around ejection opening c. An applying part h is repulsively urged forwards by a spring j and inserted in the front barrel f and has a tip g whose pressing end as a part thereof is projected from the aforementioned ejection opening c. Applying part h is constructed such that the rear of tip g is enlarged in diameter via a step e, forming a large-diametric cylindrical part k. This step e has a tapered form and is adapted to close and open ejection opening c as a step i of applying part h that is urged by spring j comes into close contact with, and out of contact with, a seat e around ejection opening c inside front barrel f.

In other words, the correction fluid feeder functions such that when it is used, tip g of applying part h is pressed against an applied object so as to open ejection opening c, whereby the fluid reserved in container body a can be fed through the front barrel f and dispensed from ejection opening c to applying surface d. When it is not used, ejection opening c is closed.

When the fluid is applied to an applied object, the tip of the valve member is abutted against the applied object so as to set back the valve member into the tubular member, whereby the fluid is flowed out through the clearance around the valve member in the ejection opening.

In the fluid feeder of the above applicator, in order to prevent accidental ejection of the fluid, the applying part at the front end is formed with a sealing element (O-ring) for sealing the applying part and the applying part is urged from the rear by a spring to achieve sealing.

In another applicator of Japanese Patent Publication HEI 08-24885 (patent document 2), the tip is provided with a valve element and a soft elastic part disposed behind the valve element, and a spring is disposed at the rearmost end to urge the valve element forwards to thereby achieve sealing.

In another applicator of Japanese Patent Application Laid-open 2006-346975 (patent document 3), the applicator tip is constructed such that a valve element is set with a sealing element and the rear end of the valve element is urged forwards by a spring to achieve sealing.

In a fluid ejector of Japanese Utility Model Publication HEI 08-10395 (patent document 4), a valve element is pressed by a spring so that the pressurized liquid is ejected from an ejection opening. The valve element is prevented from drying by a resin coating.

However, in any of the technologies disclosed in the above patent documents 1 to 3, when a high-viscosity fluid is ejected, only a lower amount can be ejected, and if the applicator has not been used for a long time, it is difficult to restore its original condition when the fluid is resumed to be ejected. Accordingly, there occurs the problem that the fluid becomes unable to be ejected even if the applicator is halfway through its life.

Additionally, in the description of patent document 4, because the space between the valve seat part of the tubular body and the valve element will not change in volume, it is impossible to secure sufficient flow passage when the fluid in the front end tip is pressurized. As a result, the fluid is unlikely to flow into the space between the valve seat part and the valve element tip, hence the fluid cannot be ejected sufficiently under imperfect pressurization of the fluid. The insufficient ejection causes the problem that the high-viscosity fluid is likely to dry up and harden, resulting in low application performance.

Patent document 1:

Utility Model Application Laid-open HEI 07-24472

Patent document 2:

Japanese Patent Publication HEI 08-24885

Patent document 3:

Japanese Patent Application Laid-open 2006-346975

Patent document 4:

Japanese Utility Model Publication HEI 08-10395

DISCLOSURE OF INVENTION

Problems to be Solved by the Invention

The present invention has been devised to solve the above conventional problems, it is therefore an object to provide a fluid feeder of an applicator having a structure that allows a fluid to flow into a tubular member and be positively pressurized at the time of an ejecting operation, which can readily eject the fluid even if the fluid becomes unlikely to flow out and allows the user to readily use over a long period of time even if a high-viscosity fluid is used.

Means for Solving the Problems

The present invention relates to a fluid feeder of an applicator.

The present invention resides in a fluid feeder of an applicator, comprising: a tubular member having a fluid ejection opening at a tip; and a valve member that is inserted into the tubular member and elastically urged forwards with a pressing end as a part of the tip projected from the ejection opening, wherein when a fluid reserved in a tank behind the tubular member is applied to an applied object, the valve member is retracted into the tubular member by abutment of the tip of the valve member against the applied object so as to flow out the fluid through the clearance around the valve member in the ejection opening, an annular inside step is formed on an inner periphery of the tubular member, a front side of the inside step is formed to have a smaller diameter than a rear side, the inner surface on the front side from the inside step to a halfway point is formed as a cylinder surface of a cylindrical form or of a gently tapered form becoming wider toward the rear toward the ejection opening, in the valve member, the periphery of a base of a rod-like part connected to the pressing end in the tip is formed so as to be able to come into hermitic contact with the inner peripheral surface of the fore part of the tubular member, forming a closing structure while the outer peripheral surface of the rear part behind the tip is formed to be a plunger-like part having a cylindrical surface or tapered surface that can be fitted into the cylinder surface on the front side of the inside step of the tubular member, in a closed state where the pressing end of the tip of the valve member is not pressed against an applied object and hence is projected out, the outer surface of the plunger-like part of the valve member is fitted into the cylinder surface of the tubular member and the periphery of the base of the rod-like part comes into hermetic contact with the inner peripheral surface of the fore part of the tubular member, in an open state where the pressing end has been pressed and pushed a constant distance or greater into the ejection opening, the plunger-like part of the valve member is positioned away from the cylinder surface of the tubular member while the periphery of the base of the rod-like part is released from the inner peripheral surface of the fore part of tubular member, and when a thrust against the pressing end is weakened after the open state and then the fluid is pressurized before returning to the closed state, the plunger-like part of the valve member is inserted into the cylinder surface of the tubular member so as to pressurize the fluid held in a space between the inner surface of the tubular member and the outer surface of the valve member while the periphery of the base of the rod-like part is released from the inner peripheral surface of the fore part of the tubular member, whereby the pressurized fluid can flow out from the ejection opening.

In the present invention, it is preferred that a diameter size difference between a maximum inside diameter of the cylinder surface of the tubular member and a maximum outside diameter of the plunger-like part of the valve member is set to be greater than 0 (mm). It is further preferable that, with respect to the diameter size difference, the maximum inside diameter of the cylinder surface is specified to be greater by 0.02 (mm) to 1 (mm) than the maximum outside diameter of the plunger-like part. This specification is defined on the presumption of an applicator for a correction fluid etc. of a normal size and based on the fact that if the above diameter size different is 1 (mm) or greater, the fluid cannot be suitably pressurized because a pressure fall occurs at the time of pressurizing.

Also, in the present invention, it is preferred that a sealing element (e.g., O-ring) that comes into hermetic contact with the inner peripheral surface in the front part of the tubular member is provided around the base of the rod-like part of the valve member.

Advantage of the Invention

According to the fluid feeders of the applicators recited in claims 1 to 3 of the present invention, the cylinder surface is formed on the inner periphery of the tubular member while the plunger-like part is formed on the outer peripheral surface of the valve member. When the ejection opening is in the closed state, the pressing end of the tip of the valve member is not pressed, hence is projected, so that the outer surface of the plunger-like part of the valve member is fitted into the cylinder surface of the tubular member while the periphery of the base of the rod-like part comes into hermetic contact with the inner peripheral surface of the fore part of the tubular member. As a result, the ejection opening can be hermetically sealed by the valve member so that it is possible to retain the fluid without its flowing out from the ejection opening.

Further, in the open state where the pressing end has been pressed and pushed a constant distance or greater into the ejection opening. Since, in the open state, the plunger-like part of the valve member is positioned away from the cylinder surface of the tubular member while the periphery of the base of the rod-like part is released from the inner peripheral surface of the fore part of the tubular member, the fluid smoothly flows through the gap between the cylinder surface and the plunger-like part along the outer periphery of the valve member from the cylinder surface toward the ejection opening.

Further, at time of the fluid being pressurized when the thrust against the pressing end is weakened after the open state and before returning to the aforementioned closed state, the plunger-like part of the valve member is inserted into the cylinder surface of the tubular member so as to pressurize the fluid held in the space between the inner surface of the tubular member and the outer surface of the valve member while the periphery of the base of the rod-like part is released from the inner peripheral surface of the fore part of the tubular member, whereby the pressurized fluid can flow out from the ejection opening. As a result, it is possible by pressure feed to drain out the fluid even if the fluid has been solidified around the ejection opening due to drying etc., thus making it possible to achieve smooth ejection of the fluid.

Accordingly, it is possible to provide a structure that allows the fluid to flow into the tubular member and be positively pressurized at the time of an ejecting operation, whereby it is possible to achieve excellent advantages that the fluid can be readily ejected even if the fluid becomes unlikely to flow out and that the user can readily use over a long period of time even if a high-viscosity fluid is used.

Here, in the present invention, when the diameter size difference between the maximum inside diameter of the cylinder surface of the tubular member and the maximum outside diameter of the plunger-like part of the valve member is set to be greater than 0 (mm), it is possible to pressurize the fluid suitably whilst inhibiting pressure fall during pressurizing and achieve smooth ejection of the fluid.

Further, in the present invention, since a sealing member that comes in close contact with the inner peripheral surface of the fore part of the tubular member is provided around the base of the rod-like part of the valve member, it is possible to positively set the ejection opening into the closed state to thereby eliminate fluid leakage.

DESCRIPTION OF REFERENCE NUMERALS

Figure 1:
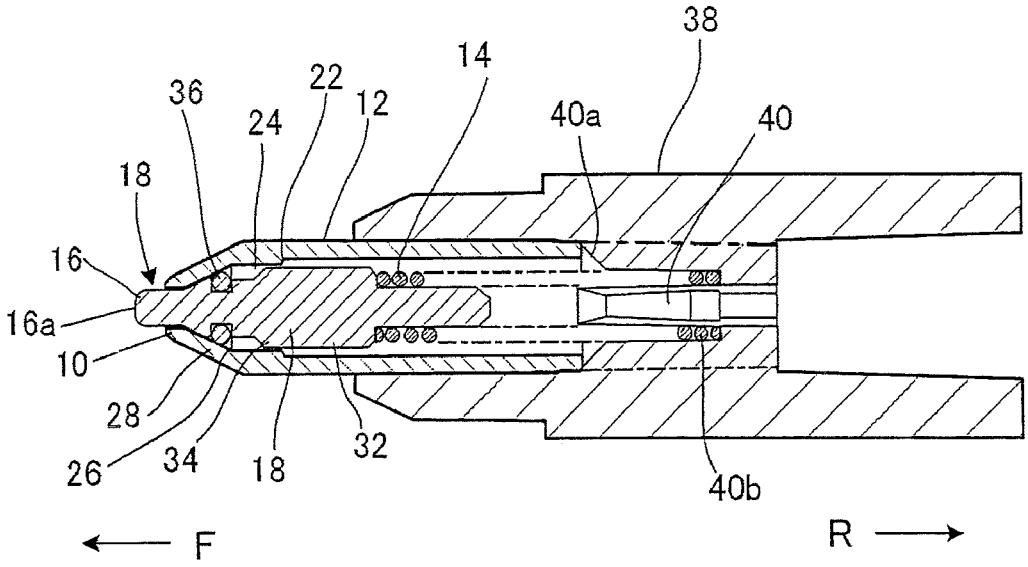
FIG. 1 is a partial vertical sectional illustrative diagram of a fluid feeder according to the embodiment of the present invention.
Figure 2:
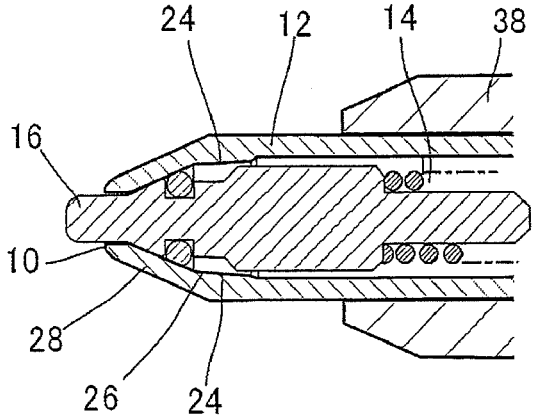
FIG. 2 is a vertical sectional illustrative diagram showing an example in which the fluid feeder in FIG. 1 is modified by forming the cylinder surface into a gently tapered configuration that becomes wider towards the rear.

10 ejection opening
12 tubular member
14 spring
16 tip
16*a* pressing end
16*b* rod-like part
16*c* base
16*d* groove
18 valve member
22 inside step
24 cylinder surface
26 halfway point
28 fore part
30 rear part
32 plunger-like part
34 step
36 sealing element
38 refill
38*a* tank
40 flow passage
40*a* reduced diametric part
40*b* reduced diametric part
42 front barrel
42*a* opening
44 rear barrel
44*a* rear end opening in rear barrel
46 clicking part
46*a* piston body
46*b* cylinder body
46*c* spring
46*d* conduit
48 fluid
52 clicking part
C1 maximum inside diameter of cylinder surface
C2 maximum outside diameter of plunger-like part
D inside diameter of tubular member on the rear side
σ1 size difference in diameter
σ2 size difference in diameter

BEST MODE FOR CARRYING OUT THE INVENTION

A fluid feeder of an applicator according to the embodiment of the present invention will be described with reference to the accompanying drawings.

FIGS. 1 to 8 show one example of a mode that is carried out by the invention. In the drawings, the components assigned with the same reference numerals represent the identical components.

Figure 6:
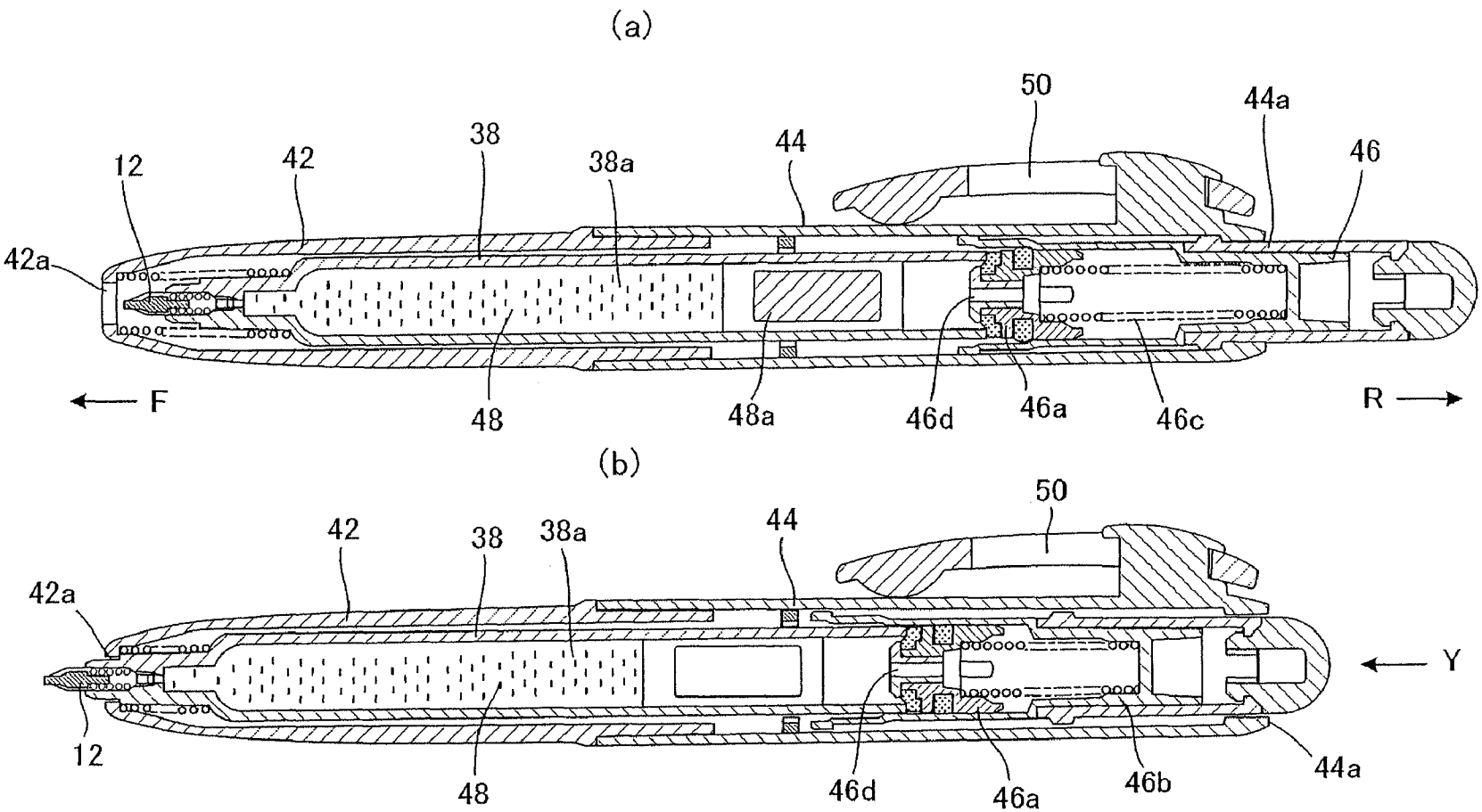
FIG. 6 is a configurational illustrative diagram of an applicator to which a refill equipped with the fluid feeder in FIG. 1 is attached, the applicator being of a type in which the refill is pressurized by a clicking rod, (a) and (b) being status illustrative diagrams of the refill when the applicator is not clicked and when the applicator is clicked, respectively.

The embodiment is a fluid feeder having a structure shown in FIG. 1, provided for a correction fluid applicator of which the overall configuration is shown in FIG. 6. Here, when the fluid feeder shown in FIGS. 1 and 6 is viewed with respect to the axial direction, the side with a tip 16 is called the front side and the side with a refill 38 and a clicking part 46 is called the rear side.

The fluid feeder according to the embodiment includes: as shown in FIGS. 1 to 4 and 6, a tubular member 12 having a fluid ejection opening 10 at a tip 16; and a valve member 18 that is inserted into the tubular member 12 and elastically urged forwards (F) by means of a spring 14 with a pressing end 16*a* as apart of tip 16, projected from the ejection opening 10, and is provided for an applicator which, when a fluid 48 reserved in a tank (storage cylinder) 38*a* on the rear (R) side of tubular member 12 is applied to an applied object, retracts valve member 18 into tubular member 12 by abutment of tip 16 of valve member 18 against the applied object so as to flow out the fluid through the clearance around valve member 18 in the aforementioned ejection opening 10.

The fluid feeder is constructed such that an annular inside step 22 is formed on the inner periphery of the aforementioned tubular member 12, the front side of the inside step 22 is formed to have a smaller diameter than the rear side, the inner surface on the front side from the inside step 22 to a halfway point 26 is formed as a cylinder surface 24 of a cylindrical form (straight surface, shown in FIG. 1) or of a gently tapered form becoming wider toward the rear (tapered surface, shown in FIG. 2) while the fore part 28 from halfway point 26 is tapered becoming narrower toward ejection opening 10.

In this fluid feeder, the outer periphery of tubular member 12 is fitted into the front end 16 of the aftermentioned refill 38 having an overall cylindrical form. The open rear end of tubular member 12 communicates with a flow passage 40 of the cylinder core of refill 38 so as to allow the fluid to flow in from tank 38*a* through the flow passage. The flow passage is reduced stepwise in two phases in diameter from the front-end opening to the rear: the first reduced diametric part 40*a* receives the rear end of tubular member 12 so as to restrain the tubular member from moving to the rear; and the second reduced diametric part 40*b* is formed with a frontward seat for receiving the rear end of spring 14 to restrain the spring from moving to the rear.

In the aforementioned valve member 18, the peripheral surface of a base 16*c* of a rod-like part 16*b* connected to the aforementioned pressing end 16*a* in the tip 16 is formed so as to be able to come into hermitic contact with the inner peripheral surface of fore part 28 of tubular member 12, forming a closing structure while the outer peripheral surface of the rear part 30 behind tip 16 is formed to be a plunger-like part 32 having a cylindrical surface or tapered surface that is fittable into cylinder surface 24 on the front side of inside step 22 of the aforementioned tubular member 12. In valve member 18, plunger-like part 32 is formed to be enlarged from tip 16 stepwise in diameter via a step 34 so that the outer peripheral surface forms a cylindrical or tapered surface that can be put into and taken out from the aforementioned cylinder surface 24.

Formed around base 16*c* of rod-like part 16*b* of the aforementioned valve member 18 is an annular groove 16*d*, in which a sealing element (e.g., O-ring or any other sealing member may also be used) 36 that creates hermetic contact with the inner peripheral surface in the front part of tubular member 12 is provided. Further, the rear end of plunger-like part 32 is reduced stepwise in diameter so that a rod-like part having a smaller diameter than that of plunger-like part 32 is extended. Spring 14 is fitted on the rod-like part in an advancing and retractable manner while the front end of spring 14 is abutted against the diameter-reduced step.

Figure 3:
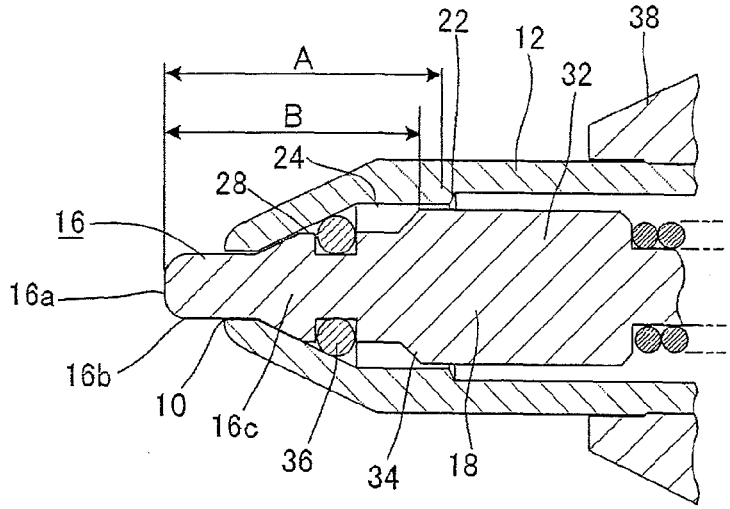
FIGS. 3 (*a*), (*b*) and (*c*) are vertical sectional illustrative diagrams showing the fluid feeder in FIG. 1 when pressurized with the opening closed, when pressurization starts and when the opening is released, respectively.
Figure 3:
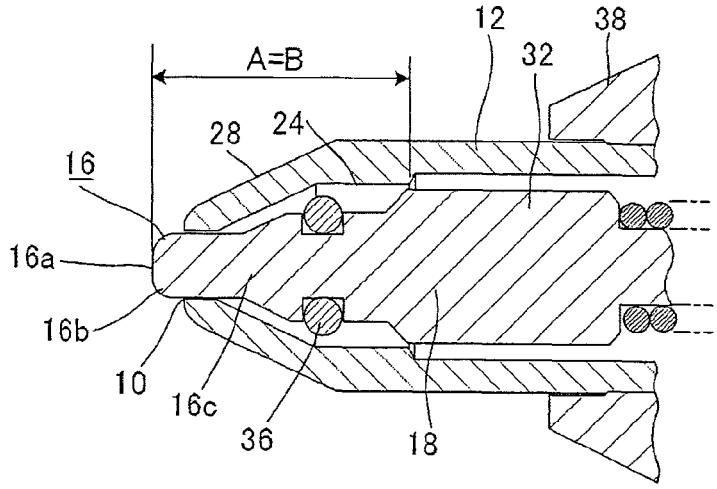
Figure 3:
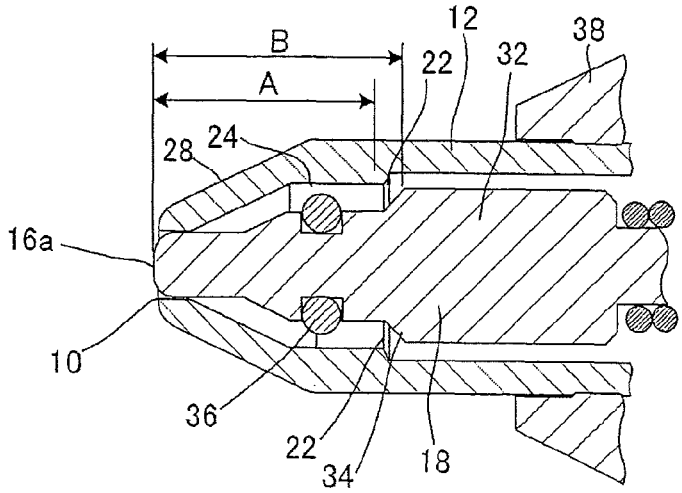
Figure 4:
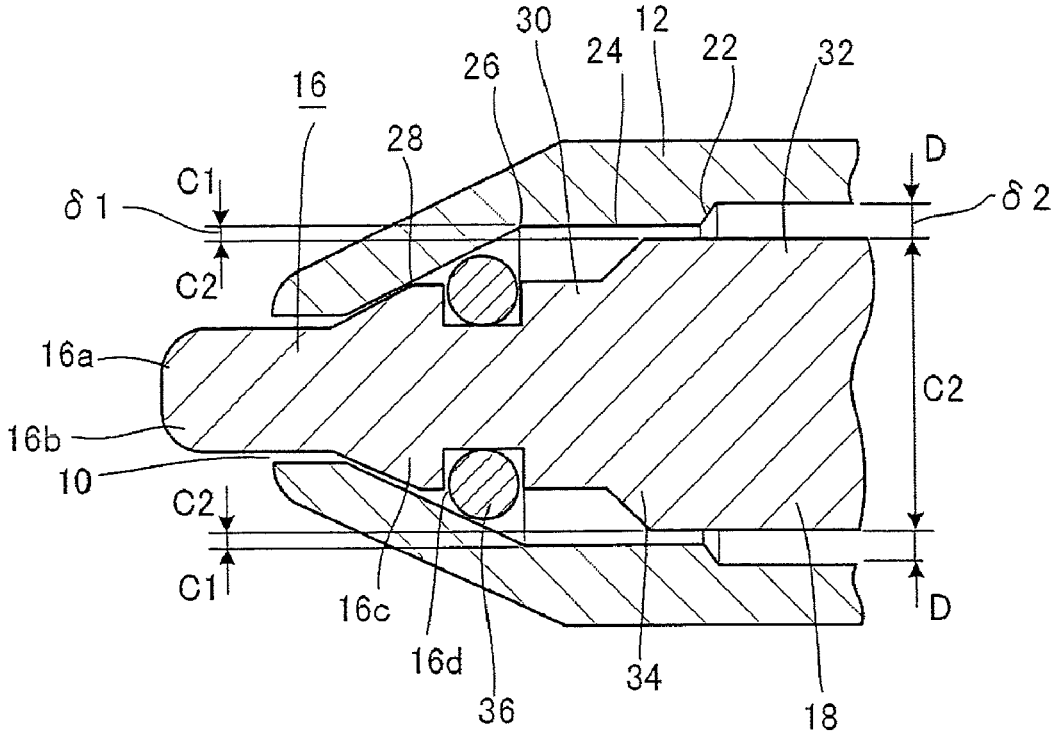
FIG. 4 is a vertical sectional illustrative diagram for illustrating the size of each part in the fluid feeder in FIG. 1.

In a closed state where pressing end 16*a* of tip 16 of the aforementioned valve member 18 is not pressed against an applied object and hence is projected out as shown in FIG. 3(*a*) or 4, the outer surface of plunger-like part 32 of valve member 18 is fitted into cylinder surface 24 of tubular member 12 while the periphery of base 16*c* of rod-like part 16*b* is put in hermetic contact with the inner peripheral surface of fore part 28 of tubular member 12.

In this case, the distance from pressing end 16*a* of tip 16 in valve member 18 to step 34 of plunger-like part 32 is expressed as B (constant) while the distance from the pressing end 16*a* to the inside step 22 of tubular member 12 is expressed as A (variable). The relationship between these distances A and B results in A−B>0 at the closed state or at the time (the end) of pressurization. When in the closed state, valve member 18 can hermetically seal ejection opening 10 so as to retain the fluid without its flowing out from ejection opening 10.

As shown in FIG. 3(*c*), in an open state where the pressing end 16*a* has been pressed and pushed a constant distance or greater into ejection opening 10, plunger-like part 32 of valve member 18 is positioned away from cylinder surface 24 of tubular member 12 while the periphery of base 16*c* of rod-like part 16*b* is released from the inner peripheral surface of fore part 28 of tubular member 12. At this open state, the relationship between the distances A and B results in A−B<0.

In this condition, the fluid smoothly flows through the gap between cylinder surface 24 and plunger-like part 32 along the outer periphery of valve member 18 from cylinder surface 24 toward ejection opening 10.

As shown in FIG. 3(*b*), when the thrust against pressing end 16*a* is weakened after the open state and the fluid is pressurized before returning to the aforementioned closed state, plunger-like part 32 of valve member 18 is inserted into cylinder surface 24 of the tubular member 12 so as to pressurize the fluid held in the space between the inner surface of tubular member 12 (cylinder surface 24 and the inner surface on the forward side) and the outer surface of valve member 18 (the outer surface on the front side of step 34 of plunger-like part 32) while the periphery of base 16*c* of rod-like part 16*b* is released from the inner peripheral surface of fore part 28 of tubular member 12, whereby the pressurized fluid can flow out from ejection opening 10. At this start of pressurization, the relationship between the aforementioned distances A and B results in A=B. From this condition, the fluid is pressurized within range of A−B>0, the fluid is pressurized and the periphery of base 16*c* of rod-like part 16*b* is released from the inner peripheral surface of fore part 28 of tubular member 12, whereby the pressurized fluid can flow out from ejection opening 10. As a result, the fluid can be discharged out from ejection opening 10 under application of pressure, so that it is possible by pressure feed to drain out the fluid even if the fluid has been solidified around ejection opening 10 due to drying etc., thus making it possible to achieve smooth ejection of the fluid.

Hence, according to the fluid feeder of the embodiment, it is possible to provide a structure that allows the fluid to flow into the tubular member and be positively pressurized at the time of an ejecting operation, whereby it is possible to achieve excellent advantages that the fluid can be readily ejected even if the fluid becomes unlikely to flow out and that the user can readily use over a long period of time even if a high-viscosity fluid is used.

Here, the diameter size difference between the maximum inside diameter C1 of the cylinder surface 24 of the tubular member 12 and the maximum outside diameter C2 of plunger-like part 32 of valve member 18, or the diameter size difference σ1 (=C1−C2) is set within the range of 0.02 to 1.0 (mm).

Further, the diameter size difference between the inside diameter D of the tubular member 12 behind inside step 22 and the maximum outside diameter C2 of plunger-like part 32, or the diameter size difference σ2 (=D−C2) is set to be greater than the above diameter size difference.

Figure 7:
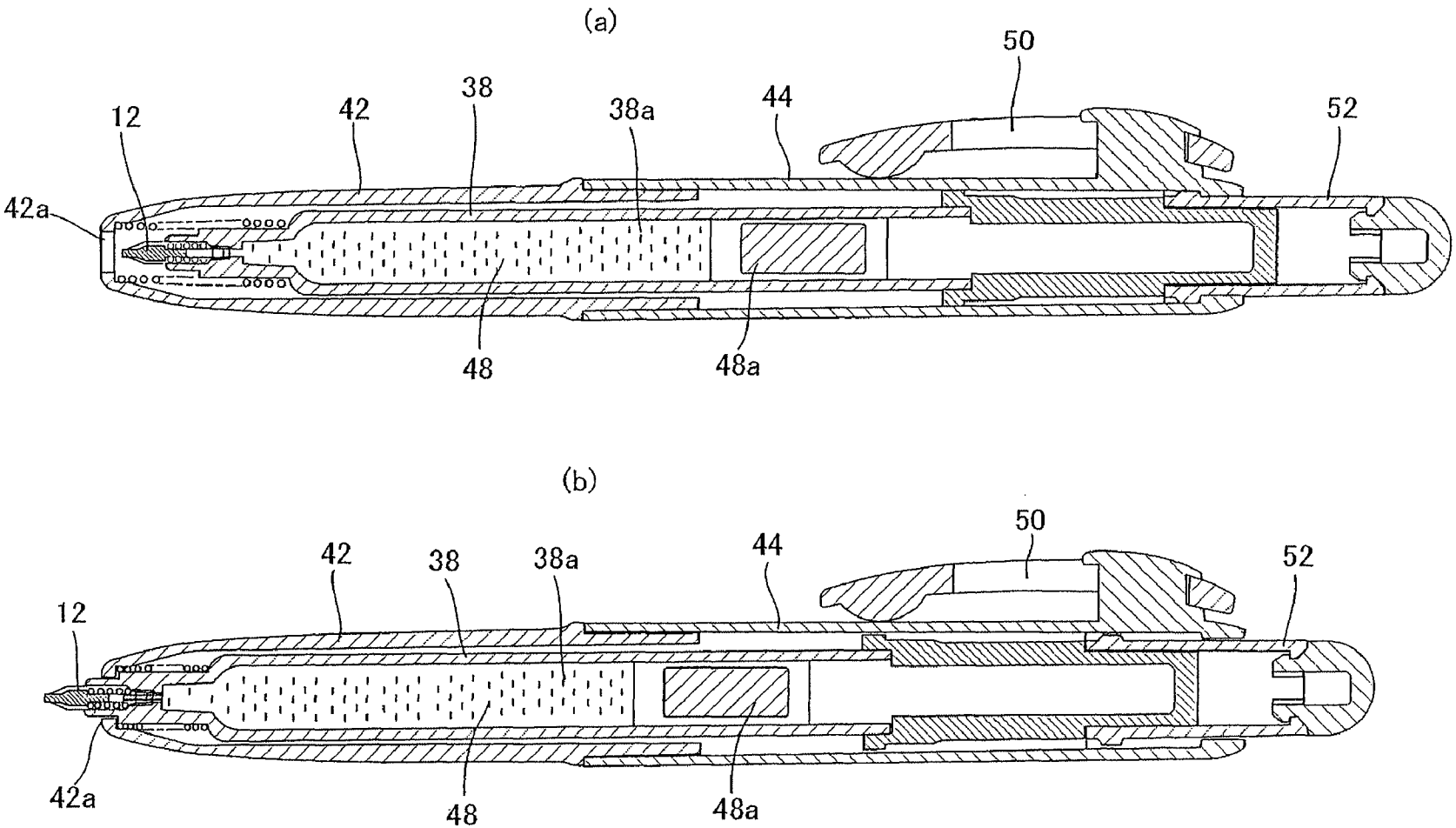
FIG. 7 is a configurational illustrative diagram of an applicator to which a refill equipped with the fluid feeder in FIG. 1 is attached, the applicator being of a type in which the refill is not pressurized by a clicking rod, (a) and (b) being status illustrative diagrams of the refill when the applicator is not clicked and when the applicator is clicked, respectively.

FIGS. 6 and 7 show examples of the overall configurations of applicators including the above fluid feeder.

The applicator shown in FIG. 6 is of a pressurizing type that is configured with a refill 38 in which the fluid feeder is fitted into the front end 16 of pipe-like tank 38*a*, the refill 38 being accommodated in the structure that is integrated of a tubular front barrel 42 and rear barrel 44 by fitting or screwing.

A clicking part 46 including a pressurizing mechanism is attached to the rear end of refill 38. The rear end of clicking part 46 is projected when refill 38 is accommodated in front barrel 42 and rear barrel 44.

Clicking part 46 is constructed such that a piston body 46*a* at the front end is slidably fitted into a cylindrical body 46*b* and urged forwards by means of a spring 46*c*. Piston body 46*a* is fitted on the rear end of refill 38, and the space between cylindrical body 46*b* and piston body 46*a* communicates with the space inside the rear part of refill 38 (conduit 46*d*). When the rear end of clicking part 46 is clicked, the space between cylindrical body 46*b* and the piston body 46*a* contracts so that the pressure inside the rear part of refill 38 increases. A follower is arranged in the rear of fluid 48 inside refill 38. Designated at 50 is a clip.

When this clicking part 46 is not clicked, the rear end of clicking part 46 is positioned to be projected out from the rear end opening 44*a* of the rear barrel. Then, as the clicking part 46 projected from the rear end opening of rear barrel 44 is pushed, tip 16 of refill 38 and the fluid feeder are projected from opening 42*a* at the front end of front barrel 42 so as to make it ready for application (FIG. 6(*b*)). A further push of clicking part 46 (in the pressurizing direction Y) raises the pressure inside the refill to feed the fluid into tubular member 12 of the fluid feeder.

FIG. 7 is an applicator according to the embodiment in which a clicking part 52 not including the above pressurizing mechanism is provided, (a) showing the state when not clicked, (b) the state when clicked. Since the other configuration than clicking part 52 is the same as that shown in FIG. 6, description is omitted by assigning the same reference numerals to the same components.

Next, the operation of the above-described embodiment will be described with reference to FIG. 5.

Figure 5:
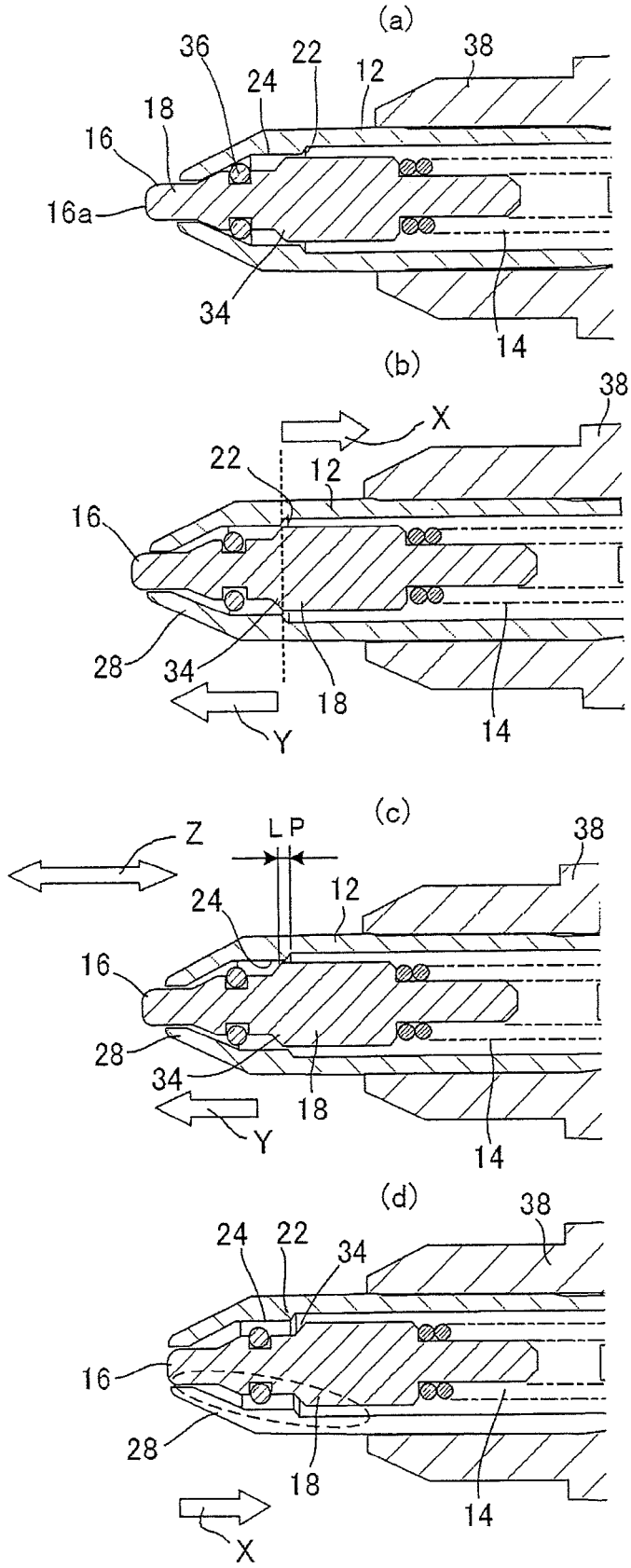
FIG. 5 (*a*) to (*d*) are vertical sectional illustrative diagrams for illustrating each operation in the fluid feeder in FIG. 1.

When the applicator is not used, the fluid feeder of the embodiment is in an equilibrium state as shown in FIG. 5(*a*) in which the outer surface of plunger-like part 32 of valve member 18 fits in the cylinder surface 24 of tubular member 12 while the sealing element (e.g. O-ring) 36 provided around base 16*c* of rod-like part 16*b* comes into hermetic contact with the inner peripheral surface of the fore part 28 of tubular member 12.

Upon use of the applicator (valve member 18 moves forwards and backwards as indicated by the arrow Z), under the pressurized state where the aforementioned pressing end 16*a* is thrust into ejection opening 10 before reaching a predetermined distance and before plunger-like part 32 of valve member 18 moves away from cylinder surface 24 of tubular member 12, if the pressing force on valve member 18 is weakened, the front step 34 of plunger-like part 32 slides forwards along cylinder surface 24 (the pressing direction X) as shown in FIG. 5(*b*) so that the space between the inner surface of tubular member 12 and the peripheral surface of valve member 18 in front of the step 34 contracts, whereby the fluid is pressurized (in the pressurizing direction Y) and ejected from ejection opening 10. As shown in FIG. 5(*c*), the range of pressurization falls within a range LP in which front step 34 of plunger-like part 32 and inside step 22 of cylinder surface 24 overlap.

Further, in the open state (the pressing direction X) where pressing end 16*a* of valve member 18 is pressed further than the state shown in FIG. 5(*c*) and moved a constant distance or greater into ejection opening 10 as shown in FIG. 5(*d*), plunger-like part 32 of valve member 18 is positioned away from cylinder surface 24 of tubular member 12 so that the periphery of base 16*c* of rod-like part 16*b* is released from the inner peripheral surface of fore part 28 of tubular member 12 and the inner side of tubular member 12 communicates with ejection opening 10, whereby the fluid passage is enlarged as indicated by the broken line in FIG. 5(*d*), establishing smooth flow of the fluid.

A variational example of the embodiment will be described with reference to FIG. 8.

Figure 8:
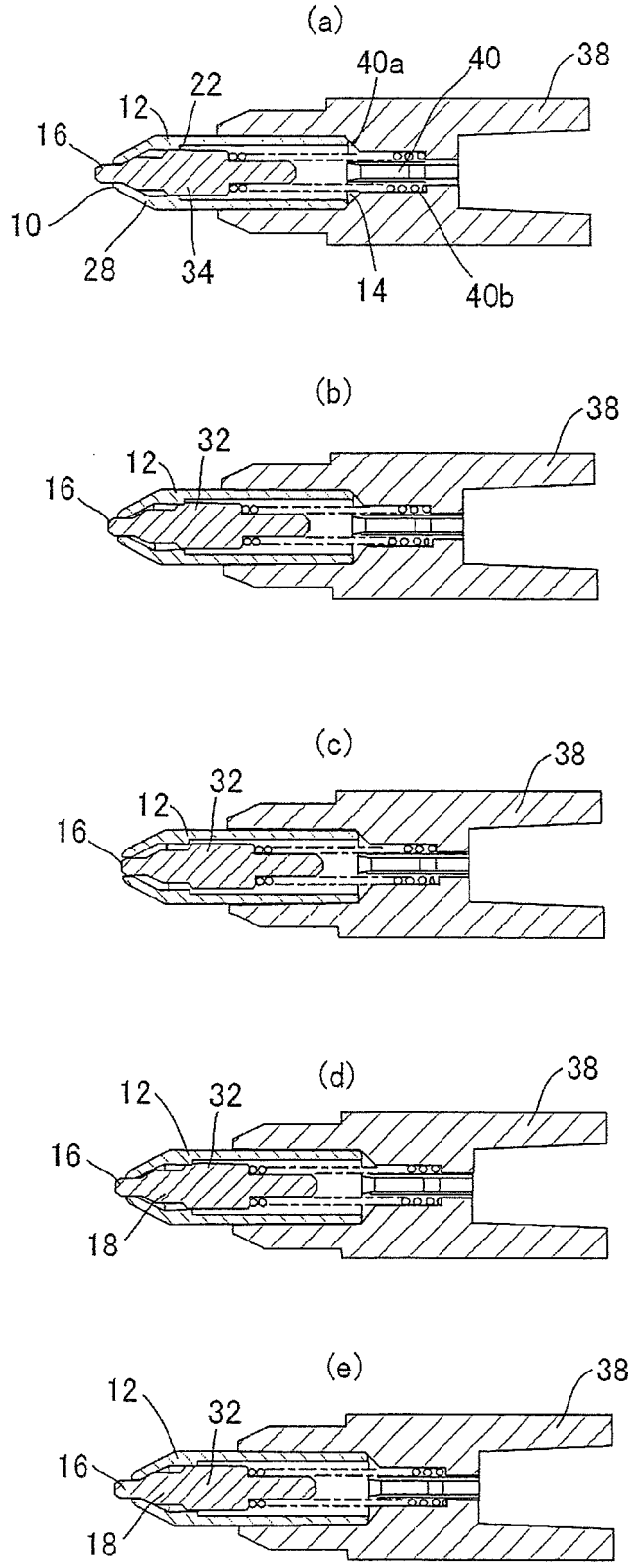
FIG. 8 (*a*) to (*e*) are operational illustrative diagrams for illustrating fluid feeders according to variational examples.
Figure 9:
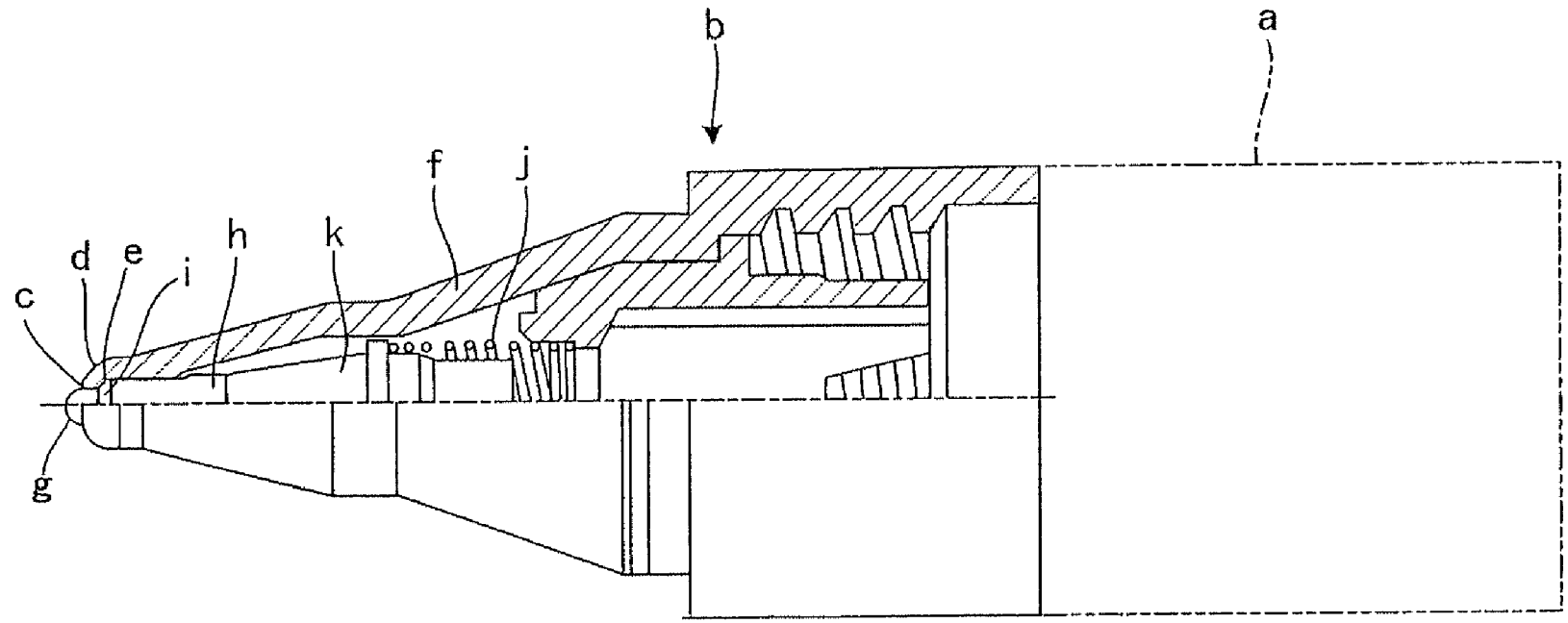
FIG. 9 is an illustrative diagram of a conventional fluid feeder.

As shown in FIG. 8, this variational example presents a fluid feeder with no sealing element (e.g., O-ring) 36 provided for valve member 18. Other components that are the same as those in the embodiment shown in FIGS. 1 to 7 are assigned with the same reference numerals. Also, the conditions in which the feeder is accommodated in front barrel 42 and rear barrel 44 of the applicator are the same as those shown in FIGS. 6 and 7, so that the description is omitted.

Since tip 16 is not formed with a groove 16*d* for holding sealing element (e.g., O-ring) 36, the structure is simple compared to that shown in FIG. 1. However, it is necessary to bring the periphery of base 16*c* of rod-like part 16*b* in tip 16 of valve member 18 into hermetic contact with the inner peripheral surface of fore part 28 of tubular member 12.

In the fluid feeder of the variational example, when in the non-pressed state, the flow passage is closed by valve member 18 as shown in FIG. 8(*a*).

Then, tip 16 of valve member 18 is abutted against an applied object so that valve member 18 is moved backward inside tubular member 12 and the pressing end 16*a* is pushed into ejection opening 10 by a certain distance. FIG. 8(*b*) shows the state before cylinder surface 24 of tubular member 12 and plunger-like part 32 of valve member 18 separate from each other.

When tip 16 of valve member 18 is further pushed in, plunger-like part 32 of valve member 18 is separated from cylinder surface 24 of tubular member 12 as shown in FIG. 8(*a*), presenting an open state. The fluid flows into tubular member 12.

Thereafter, when the pressing force against valve member 18 is weakened as shown in FIG. 8(*d*), front step 34 of plunger-like part 32 slides forwards along cylinder surface 24, whereby the space between the inner surface of tubular member 12 and the peripheral surface of valve member 18 in front of the step 34 contracts so as to pressurize the fluid and eject the fluid from ejection opening 10 (at the time of pressurizing).

When ejection is completed, ejection opening 10 is closed by valve member 18, as shown in FIG. 8(*e*). If the fluid is further wanted to be applied, the above steps (a) to (e) may be repeated again.

Here, the fluid feeder of the applicator of the present invention should not be limited to the above-described embodiments, and it goes without saying that various changes can be made therein without departing from the scope of the invention.

INDUSTRIAL APPLICABILITY

The fluid feeder of the present invention can be applied to the fluid feeder of applicators for applying a fluid such as correction fluid applicators (correction pens) for applying a correction fluid to paper, markers for applying an ink, cosmetic applicators for applying cosmetics and the like.

The invention claimed is:

1. A fluid feeder of an applicator, comprising:

a tubular member having a fluid ejection opening at a tip; and a valve member that is inserted into the tubular member and elastically urged forwards with a pressing end as a part of the tip projected from the ejection opening, wherein when a fluid reserved in a tank behind the tubular member is applied to an applied object, the valve member is retracted into the tubular member by abutment of the tip of the valve member against the applied object so as to flow out the fluid through a clearance around the valve member in the ejection opening, an annular inside step is formed on an inner periphery of the tubular member, a front side of the inside step is formed to have a smaller diameter than a rear side, an inner surface on the front side from the inside step to a halfway point is formed as a cylinder surface of a cylindrical form or of a gently tapered form becoming wider toward the rear while a fore part from the halfway point is becoming narrower toward the ejection opening, in the valve member, a periphery of a base of a rod-like part connected to the pressing end in the tip is formed so as to be able to come into hermitic contact with an inner peripheral surface of the fore part of the tubular member, forming a closing structure while an outer peripheral surface of a rear part behind the tip is formed to be a plunger-like part having a cylindrical surface or tapered surface that can be fitted into the cylinder surface on the front side of the inside step of the tubular member, in a closed state where the pressing end of the tip of the valve member is not pressed and hence is projected out, the outer surface of the plunger-like part of the valve member is fitted into the cylinder surface of the tubular member and the periphery of the base of the rod-like part comes into hermetic contact with the inner peripheral surface of the fore part of the tubular member, in an open state where the pressing end has been pressed and pushed a constant distance or greater into the ejection opening, the plunger-like part of the valve member is positioned away from the cylinder surface of the tubular member while the periphery of the base of the rod-like part is released from the inner peripheral surface of the fore part of tubular member, and when a thrust against the pressing end is weakened after the open state and then the fluid is pressurized before returning to the closed state, the plunger-like part of the valve member is inserted into the cylinder surface of the tubular member so as to pressurize the fluid held in a space between an inner surface of the tubular member and an outer surface of the valve member while the periphery of the base of the rod-like part is released from the inner peripheral surface of the fore part of the tubular member, whereby the pressurized fluid can flow out from the ejection opening.

2. The fluid feeder according to claim 1, wherein a diameter size difference between a maximum inside diameter of the cylinder surface of the tubular member and a maximum outside diameter of the plunger-like part of the valve member is set to be greater than 0 (mm).

3. The fluid feeder according to claim 1, wherein a sealing element that comes into hermetic contact with the inner peripheral surface in the front part of the tubular member is provided around the base of the rod-like part of the valve member.

* * * * *